US007155757B1

(12) United States Patent
Zamora, Jr.

(10) Patent No.: US 7,155,757 B1
(45) Date of Patent: Jan. 2, 2007

(54) STORE AWAY SHOWER CHAIR

(76) Inventor: Pedro Zamora, Jr., 15210 Domar Ave., Norwalk, CA (US) 90630

( * ) Notice: Subject to any disclaimer, the term of this patent is extended or adjusted under 35 U.S.C. 154(b) by 139 days.

(21) Appl. No.: 10/773,999

(22) Filed: Feb. 6, 2004

(51) Int. Cl.
*A47K 3/022* (2006.01)

(52) U.S. Cl. ..... 4/579

(58) Field of Classification Search ..... 4/560.1, 4/573.1, 578.1–579, 611
See application file for complete search history.

(56) References Cited

U.S. PATENT DOCUMENTS 4,150,445 A 4/1979 Bailey
4,168,549 A 9/1979 Davies
4,359,791 A 11/1982 Thomas
4,472,844 A 9/1984 Mace
5,373,591 A * 12/1994 Myers ..... 4/560.1
5,465,437 A * 11/1995 Herman ..... 4/611
5,558,022 A * 9/1996 Mason et al. ..... 104/126
5,561,868 A * 10/1996 Campbell ..... 4/560.1
5,590,427 A * 1/1997 Weterings et al. ..... 4/611
5,606,751 A * 3/1997 Baker ..... 4/560.1
5,740,563 A 4/1998 Gaddy
6,035,459 A 3/2000 Sadek
6,199,226 B1 3/2001 Steadman
6,226,810 B1 5/2001 Weddendorf et al.
6,334,225 B1 * 1/2002 Brinkmann ..... 4/560.1

* cited by examiner

*Primary Examiner*—Charles E. Phillips
(74) *Attorney, Agent, or Firm*—Blakely, Sokoloff, Taylor & Zafman, LLP

(57) ABSTRACT

Various embodiments of the invention relate to a seat mounted on wheels for rolling along wheel tracks of parallel longitudinal members of a frame having end members connecting the longitudinal members. The frame may be placed on an upper surface of a bath enclosure such as a bathtub or shower unit and turnbuckles in the longitudinal members may be used to friction fit the longitudinal members to vertical surfaces at the end of the bathtub or shower unit. Moreover, the seat may have a bottom portion hingedly attached to a seat back portion so that the seat can be stowed at one end of the bath enclosure by folding the bottom portion towards the back portion.

15 Claims, 6 Drawing Sheets

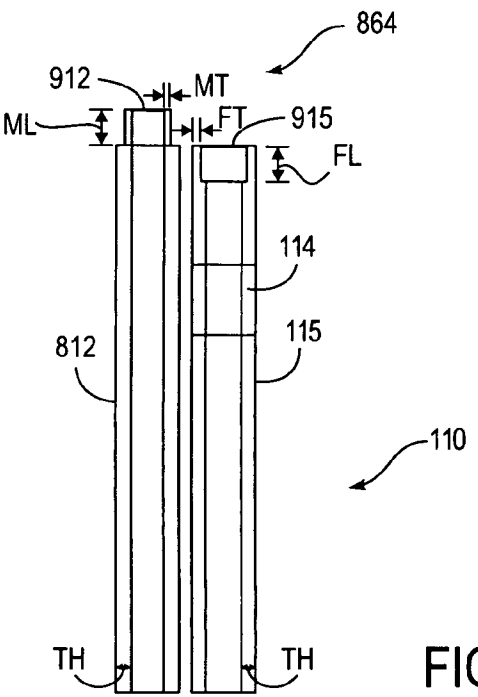
FIG. 9
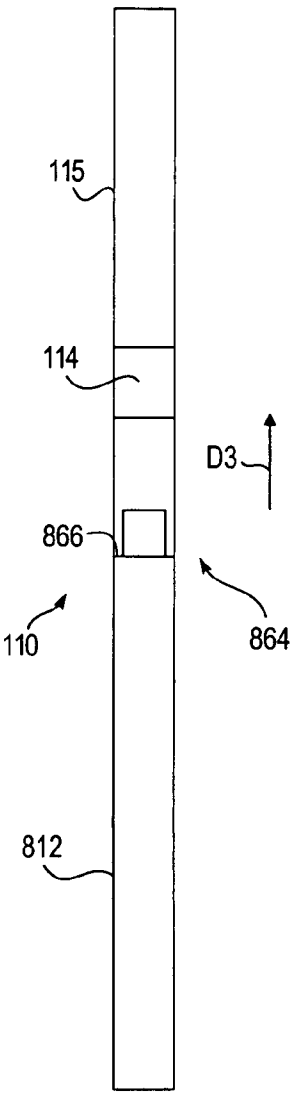
FIG. 8
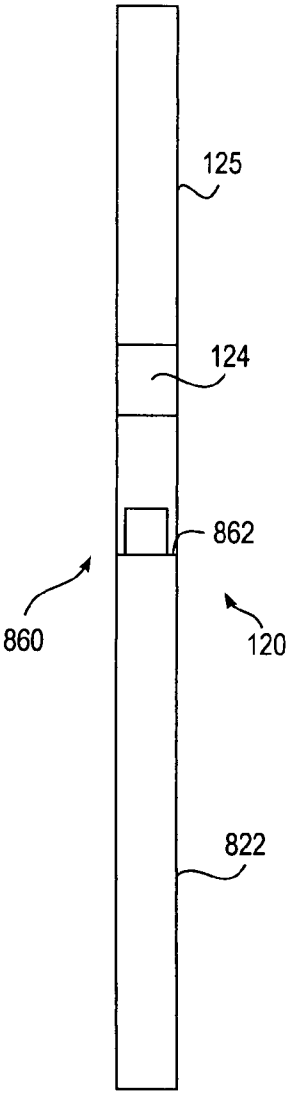

STORE AWAY SHOWER CHAIR

FIELD

Multi-position store away shower chair.

BACKGROUND

It is difficult for persons with temporary or permanent physical disabilities to get into, get out of, and bathe in a bath enclosure, such as a bathtub or shower. For example, a disabled person may risk injury due to tripping, slipping, or falling while entering or leaving a bathtub or shower. Moreover, once in the bathtub or shower, a disabled person may have difficulty changing position and manipulating bathtub or shower controls.

As a result, designs exist for devices that include a seat in the bathtub or shower unit for a disabled person to climb in to use and exit from. However such designs typically fall short in settings when the bathtub or shower must is not to be damaged by the device, when the bathtub or shower must be shared by people who do not need the device, or when the disabled person desires to use the device at a different bathtub or shower, such as when traveling.

BRIEF DESCRIPTION OF THE DRAWINGS

Embodiments are illustrated by way of example and not by way of limitation in the figures of the accompanying drawings in which like references indicate similar elements. It should be noted that references to "an" embodiment in this disclosure are not necessarily to the same embodiment, and they mean at least one.

FIG. 8 is a top plan view of a pair of longitudinal members having a male/female joint to separate the longitudinal members into two portions of length, in accordance with one embodiment of the invention, FIG. 9 is a top plan view of a longitudinal member separated into two portions of length at a male/female joint, in accordance with one embodiment of the invention.

DETAILED DESCRIPTION

Figure 1:
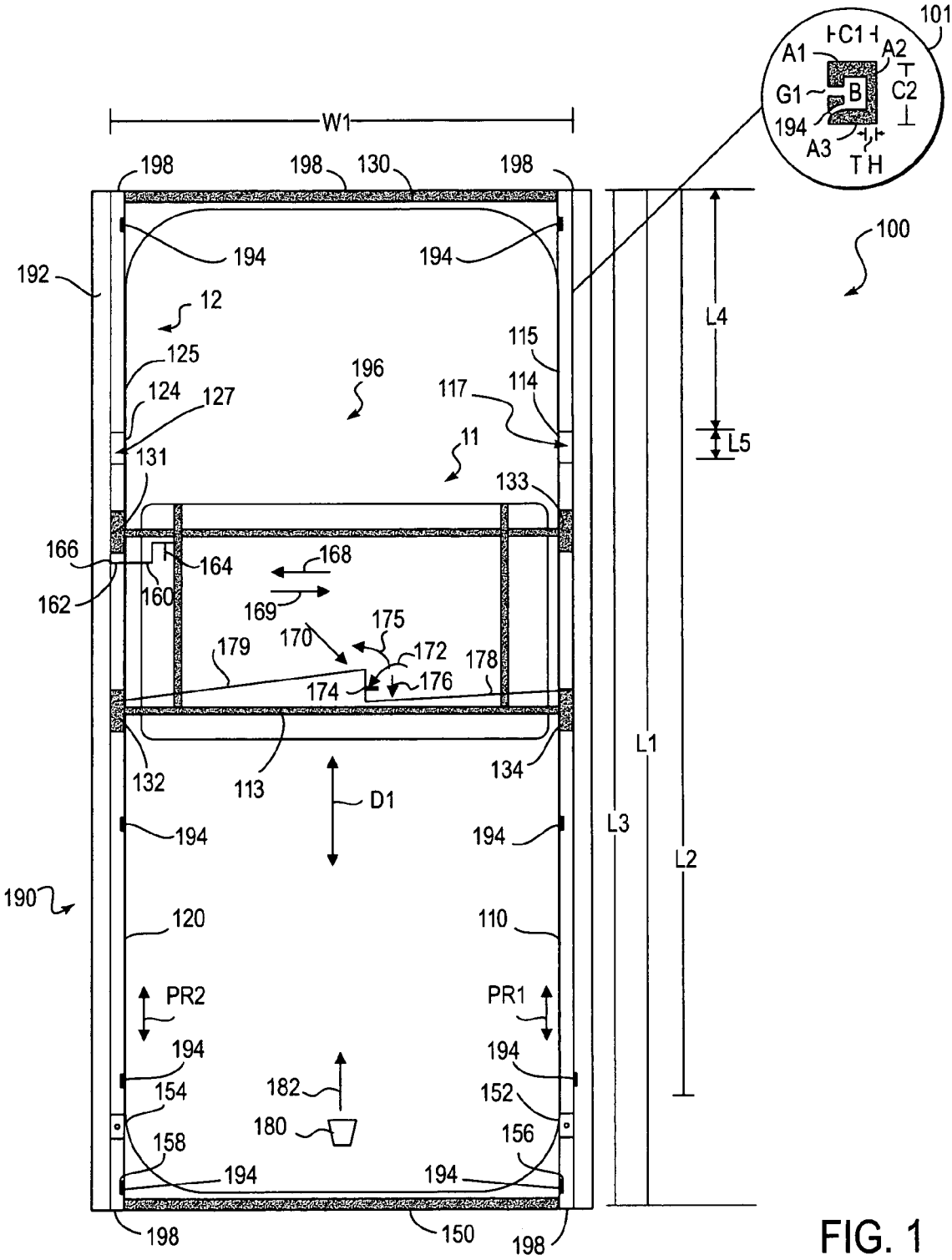
FIG. 1 is a top view of a shower chair on an upper surface of a bath enclosure, according to one embodiment of the invention.

FIG. 1 is a top view of a shower chair on an upper surface of a bath enclosure, according to one embodiment of the invention. FIG. 1 shows seat 11 mounted on wheels 131, 132, 133, and 134. Wheels 133 and 134 are shown on first wheel track 117 of first longitudinal member 110, and wheels 131 and 132 are shown on second wheel track 127 of second longitudinal member 120. FIG. 1 also shows first and second longitudinal members 110 and 120 as part of frame 12 where first and second longitudinal members 110 and 120 are retained in substantially parallel relation by first end member 150 and second end member 130. In addition, FIG. 1 shows frame 12 disposed on upper surface 192 of bath enclosure 190.

According to embodiments, wheels 131 through 134 may be introduced to first and second wheel tracks 117 and 127, such as by being introduced into a passage of first and second longitudinal members 110 and 120 through first and second slots 114 and 124 of first and second longitudinal members 110 and 120. Thus, it is possible to introduce wheels 131 through 134 onto first and second wheel tracks 117 and 127 prior to or after attaching first end member 150 and/or second end member 130 to first and second longitudinal members 110 and 120.

Seat 11 is also shown mounted on or including carriage 113, such as a chassis for attaching seat 11 to wheels 131, 132, 133, and 134. Thus, seat 11, (e.g., such as a chair or platform for a person to sit on), wheels 131–134, carriage 113, and frame 12 may have sufficient structure to support the weight of a human subject, such as a physically disabled person, while getting into seat 11, sitting on seat 11 while causing wheels 131–134 to roll along first and second wheel tracks 117 and 127, and when getting off of seat 11, such as to exit bath enclosure 190.

FIG. 1 also shows first turn buckle 152 to couple first longitudinal member 110 to first front end 156, and second turn buckle 155 to couple second longitudinal member 120 to second front end 158, to provide longitudinal adjustment of frame 12, such as in directions D1. Thus, longitudinal adjustments, in direction D1, permit frame 12 to form a friction fit with bath enclosure 190 such as at end surfaces 198 (e.g., such as at vertical end surfaces of bath enclosure 190 or walls adjacent bath enclosure 190).

According to embodiments, bath enclosure 190 may be any standard, custom, or special style or type of bath enclosure, bathtub, shower, or other appropriate bath enclosure having an upper surface sufficient to retain first and second longitudinal member 110 and 120, such as by friction fit of first and second longitudinal members 110 and 120, and/or friction fit of frame 12, and/or disposition of frame 12 on upper surface 192 is sufficient so that seat 11 is stable during use as described herein. For example, longitudinal adjustments of first and second turnbuckles 152 and 154 may permit frame 12 including first and second end members 150 and 130 to friction fit to bath enclosure 190 having length L3 in the range of between 53 and 73 inches.

According to embodiments, it is also contemplated that first and second longitudinal members 110 and 120 may friction fit to bath enclosure 190 without including and/or without friction fit contribution from first and second end members 150 and 130. Thus, it would be possible for first and second longitudinal members 110 and 120 to pressure fit to end surfaces 198, such as vertical surfaces of bath enclosure 190, even if frame 12 excluded first and second end members 150 and 130. For example, first and second turnbuckles 152 and 154 may be adjusted (e.g., such as by rotation) to cause first and second pressures PR1 and PR2 that provide sufficient tensile strain or pressure by first and second longitudinal members 110 and 120, and/or first and second end members 150 and 130 onto end surfaces 198 to retain frame 12 on upper surface 192 during use of seat 11.

In addition, FIG. 1 shows frame 12 having width W1 and length L1, first and second longitudinal members 110 and 120 having length L2, and bath enclosure having length L3

(e.g., such as a length defining vertical surfaces, such as end surfaces 198 of bath enclosure 190). Exploded view 101 of FIG. 1, shows a cross section of first and/or second longitudinal members 110 and 120. As shown in exploded view 101, first and second longitudinal members 110 and 120 may have walls, such as walls A1, A2, and A3 that enclose first and second wheel tracks 127 and 117 on three sides for a majority of length L2. For example, first and second longitudinal members 110 and 120 may have walls A1, A2, and A3 defining passage B to retain or secure wheels 131 through 134 and having a groove G1 to accommodate an axle extending into passage B and into an inner diameter of the wheels, such as into a bearing or bushing (e.g., such as a bearing having ball bearings, or a bushing of washers of a plastic material). For example, according to embodiments, wheels 131 through 134 may be a type of wheel such as that used for in-line skating, roller skating, or skateboarding, inserted with a hard plastic bushing, a bushing having washers of plastic disposed parallel to each other, or another bearing or bushing that is resistant or impervious to water.

Corresponding to introducing wheels 131 through 134 to first and second wheel tracks 117 and 127 through first and second slots 114 and 124 of first and second longitudinal members 110 and 120, axles extending into passage B may be introduced into groove G1 by a vertical slot from groove G1 extending upward to second slots 114 and 124 to accommodate the axles when introducing the wheels into passage B.

Moreover, walls A1 and A3 may have length C1 between one inch and two inches, such as 1.25 inches. Similarly, wall A2 may have length C2 between two and four inches, such as three inches. Also, groove G1 may be a groove of between ¼ inch and 1 inch, such as a groove of ½ inch distance. Thus, passage B may have an inner dimension of three inches by 1.25 inches. Similarly, width W1 may be a width between 24 inches and 34 inches, such as a width of 27 inches in distance.

Consequently, wheels 131 through 134 will be able to roll along first and second wheel track 117 and 127 for a majority of length L2. Moreover, it is to be appreciated, that the under surface of first and second longitudinal members 110 and 120 may be of a material to assist in retaining, supporting, and/or stabilizing first and second longitudinal members 110 and 120 when placed on upper surface 192. Furthermore, the under surface of first and second longitudinal members 110 and 120 may include a material to protect upper surface 192 from scratches or damage, such as a padding, a polyurethane, a rubber, a foam, or another appropriate materials that may protect a porcelain, metal, or plastic surface from scratching or damage.

It is also considered that first and second longitudinal members 110 and 120 having length man include drain holes through their inner walls at positions along length L2 to drain water or other liquid or matter from passage B. For instance, FIG. 1 shows (including explode view 101) drain holes 194 along inner wall A4 to drain water or other liquid or matter from passage B into inner region 196 of bath enclosure 190. Although, holes 194 are shown in FIG. 1 at specific locations along length L2, it is to be appreciated that various spacing may be used for placing holes 194 along length L2, such as by including one hole through first and second longitudinal members 110 and 120 proximate to end 130 and just past turnbuckles 154 and 152 in direction 182 for a total of four holes. It can also be appreciated that holes 194 may have various sufficient diameters, shapes, and angles with respect to passage B for draining liquid or matter from passage B.

FIG. 1 also shows braking mechanism 170 for restricting motion of seat 11 along first and second wheel tracks 117 and 127, such as by restricting motion of seat 11 with respect to directions D1. For example, braking mechanism 170 may include lever 172 attached at pivot 174 to push and pull first cable 178 and second cable 179 to restrict or release motion of seat 11 with respect to direction D1. For example, movement of lever 172 in the direction shown by arrow 176 may pull first and second cables 178 and 179 so as to cause a braking or other device in wheels 132 and 134 to restrict motion or stop wheels 132 and 134. Alternatively, moving lever 172 in the direction of arrow 175 may push or release tension in first and second cables 178 and 179 so as to release or disengage a braking or other mechanism at wheel 132 and 134 so that wheel 132 and wheel 134 may roll freely. It is to be appreciated that braking mechanism 170 may be a device that restricts motion of only one of wheels 132 or 134. Moreover, braking mechanism 170 may be located or configured to restrict motion of seat 11 by operating on wheels 131 and/or 133 instead of 132 and/or 134. Therefore, braking mechanism 170 may be used to lock or restrict motion of seat 11 at various positions along length L2.

For instance, it is considered that braking mechanism 170 may be a device that restricts motion of seat 11 by pushing a pin, shaft, or cylinder into or through a receptacle or hole in wall A2 accessible from passage B (see exploded view 101 of FIG. 1). Thus, wall A2 of first and/or second longitudinal member 110 and/or 120 may have a number of receptacles or holes spaced at intervals in direction D1 along length L2 to receive and retain a pin, shaft, or cylinder to sufficiently secure seat 11 at positions along length L2 during use of seat 11. Specifically, movement of lever 172 in the direction shown by arrow 175 may push first and second cables 178 and 179 so as to cause a shaft near wheels 132 and 134 to extend into or through a hole or receptacle in wall A2 of first and second longitudinal members 110 and 120. Alternatively, moving lever 172 in the direction of arrow 176 may pull or release tension in first and second cables 178 and 179 so as to cause a shaft extending through or engaging a hole or receptacle in wall A2 of first and second longitudinal members 110 and 120.

Moreover, instead of, or in addition to braking mechanism 170, seat 11 may have brake device 160, where brake device 160 includes shaft 162 (e.g., such as a shaft disposed through groove G1), and handle 164 (e.g., such as a handle to be manipulated by a person's hand), as shown in FIG. 1. Thus, movement of handle 164 in direction 168 may cause shaft 162 to extend shaft 162 to engage holes or receptacles in wall A2, such as hole 166. Alternatively, movement of handle 164 in direction 169 may cause shaft 162 to retract shaft 162 disengage holes or receptacles in wall A2, such as hole 166. Note that brake device 160, seat 11, and/or carriage 113 may also include a coupling for slideably attaching brake device 160 thereto, so that brake device 160 can be moved in directions 168 and 169 as described above. Thus, brake device 160 may sufficiently secure seat 11 at a position along length L2 during use of seat 11. Furthermore, it is to be appreciated that one or more of brake device 160 may be positioned at various locations on seat 11 adjacent to first and/or second longitudinal members 110 and/or 120, such as near any one or more of wheels 131–134.

FIG. 1 also shows first slot 114 and second slot 124 in wall A1 of first and second longitudinal members 110 and 120 where first and second slots 114 and 124 have a sufficient size to allow wheels 134 and 132 to fit therethrough respectively. For example, first and second slot 114 and 124 may have length L5 between 2 and 4 inches, such as a length of 3 inches in distance. Furthermore, FIG. 1 shows first and second back lengths 115 and 125 between first and second slots 114 and 124, and end surface 198. For instance, first and second back lengths 115 and 125 may have length L4 between 6 inches and 20 inches such as a length of 12 inches in distance.

Associated with and oriented towards a "front" of frame 12 and seat 11, FIG. 1 also shows water spout 180 for ejecting a stream of water in direction 182. It is contemplated that spout 180 may be any type of shower head, shower massager, fixed shower head, adjustable shower head, removable shower head, (e.g., such as a water nozzle or spout on a flexible hose that extends from the wall a distance to the nozzle), or bathtub water spout or nozzle. It can be appreciated that a person may sit on seat 11 and face towards or away from spout 180.

According to embodiments, first and second longitudinal members 110 and 120, first and second end members 150 and 130, and/or carriage 113 may be made of various water resistant, water impervious, or rustproof materials having a hardness and strength to operate and support use as described herein, such as stainless steel, aluminum, tin, titanium, glass or fiber infused plastic, molded plastic (e.g., such as injection molded), extruded plastic, plastic, resin, epoxy, forged or cast metal, or other metals or plastics with sufficient hardness and durability to function as described herein. For example, first and second longitudinal members 110 and 120 may be plastic having thickness TH of between ⅛ inch and ½ inch in thickness (e.g., such as a plastic material having a ¼ inch thickness). Alternatively, the longitudinal members may be forged or cast of metal, stainless steel, or aluminum having thickness TH, as shown in exploded view 101 of between 1/16 inch and ¼ inch (e.g., such as having a thickness of ⅛ inch).

Similarly, seat 11 may be a material as described above with respect to first and second longitudinal members 110 and 120, or may be a more flexible or elastic version of one of those materials. For example, seat 11 may be an injection molded plastic seat mounted on carriage 113, which may be aluminum (e.g., such as a chassis including axles, all of which are made of forged or cast aluminum or aluminum alloy).

Figure 2:
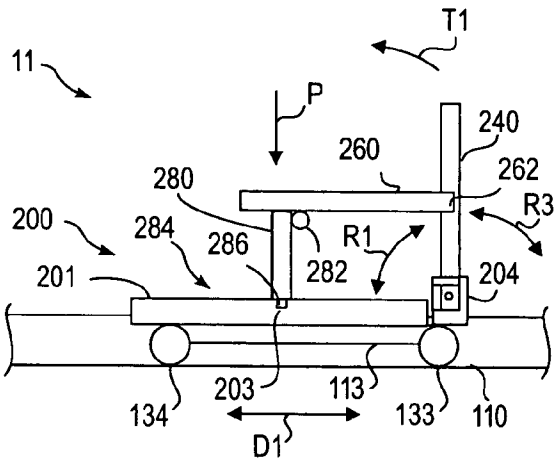
FIG. 2 is a cross section view of a shower chair, according to one embodiment of the invention.

According to embodiments, seat 11 may have a back portion and a seat portion. For example, FIG. 2 is a cross section view of a shower chair, according to one embodiment of the invention. FIG. 2 shows seat 11 having back portion 240 and seat portion 201 hingedly coupled to back portion 240 at hinge 204, where seat portion 201 and/or back portion 240 are movable or foldable along arc R1. For example, back portion 240 may be retained in an upright position, as shown in FIG. 2, or in a slightly reclined position, such as if back portion 240 were disposed at an angle along arc R3 (e.g., such as described below) by the force of gravity thereon and/or the friction residing at hinge 204. However, if back portion 240 is disposed along arc R1 beyond its vertical position, as shown in FIG. 2, such as by 10° or more, the force of gravity upon back portion 240 may fold back portion 240 further along arc R1 and onto bottom portion 201. It is to be appreciated that seat 11 may include more than one hinge, such as more than one of hinge 204.

FIG. 2 also shows armrest 260 such as a stowable armrest that may pivot or slide into a sleeve at stow 262. FIG. 2 also shows armrest 260, which may be an arm platform, hingedly coupled to support member 280 at hinge 282, where support member 280 is engaging horizontal surface 284 to reduce tipping of back portion 240, such as in direction T1, when pressure P is applied to arm platform 260. According to embodiments, support member 280 may include pin 286 for fitting into and being laterally secure in receptacle 203 in horizontal surface 284. Thus, engagement of pin 286 to receptacle 203 may fix the end of support member 280 having pin 286 at a location along horizontal surface 284, such as to prohibit support member 280 from swinging back and forth along an axis provided at hinge 282. It is to be appreciated that armrest 260, stow 262, support member 280, horizontal surface 284, pin 286, receptacle 203, and/or hinge 282 may be provided on either and/or both sides of back portion 240 so that a person seated on seat portion 201 may rest either/or both of that person's arms on an armrest. It is also contemplated that seat 11 may be configured without armrests.

Figure 3:
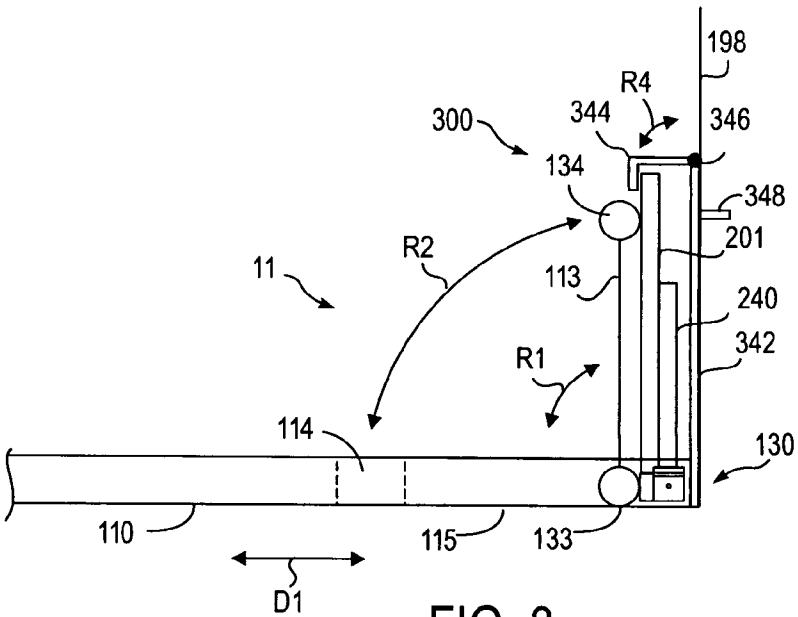
FIG. 3 shows the shower chair of FIG. 2 in the stowed position, according to one embodiment of the invention.

Consequently, seat portion 201 may be hingedly coupled to back portion 240 such that seat portion 201 is movable between use position 200 and a stowed position. For example, FIG. 3 shows the shower chair of FIG. 2 in the stowed position, according to one embodiment of the invention. FIG. 3 shows seat portion 201 in stowed position 300. Specifically, when seat 11 is in the appropriate position along direction D1, wheels 132 and 134, may be moved through first and second slot 114 and 124 along wheel arc R2, so that seat portion 201 can be engaged by hook member 344 extending from second end member 130 to engage seat portion 201 when in stowed position 300. In other words, wheels 131 through 134 may have front pair of wheels 132 and 134 and rear pair of wheels 131 and 133; and first and second longitudinal members 110 and 120 may have first and second slot 114 and 124 in upper wall A1 and overlying front wheels 132 and 134 when seat 11 is at in extreme of its range of motion along first and second wheel tracks 117 and 127, such as when seat 11 is at an extreme range of motion towards second end member 130.

For example, hook member 344 may be a structure for retaining seat 201 in stowed position 300 such as a hold down, a keeper, a latch, a hook, and/or a device for biasing seat 11 in an upright position by overcoming a force attempting to change the position of seat 11 to a position other than upright (e.g., such as by overcoming a force applied by gravity to push seat 11 towards use position 200). Likewise, a self biasing device or system (e.g., such as a system including a spring force) for self biasing seat 11 may cause seat 11 to be biased in use position 200 or in stowed position 300 by overcoming a threshold force attempting to change the position of seat 11, but allowing a force greater than the threshold force to transition the position of seat 11 between use position 200 and stowed position 300 along arc R2. Thus, seat portion 201 can be folded into an orientation parallel to the orientation of back portion 240, and/or into a vertical position above and proximate to second end 130.

FIG. 3 shows hinge 346 for hingedly attaching member 342 to hook member 344 so that hook member 344 may move along arc R4. FIG. 3 also shows member 342 attached to hook member 344 and second end 130, such as to support hook member 344 sufficiently for engaging seat portion 201. Furthermore, FIG. 3 shows attachment 348 attached to member 342, to assist member 342 in supporting hook member 344. It is to be appreciated that attachment 348 may be attached to hook member 344 instead of member 342, and that in such configuration, member 342 may be removed. For example, attachment 348 may be a screw, bolt, adhesive, tape (e.g., such as double sided tape), or other appropriate attachment device with sufficient strength to fix member 342 or hook member 344 to end surface 198.

Figure 4:
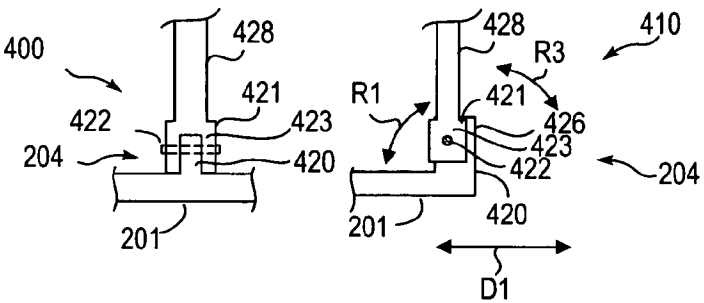
FIG. 4 is a front view and side view of a hinge for use with a shower chair, according to one embodiment of the invention.

According to embodiments hinge 204 may be configured to allow seat portion 201 to move along arc R1, but prevent or resist back portion 240 from moving along arc R3. For example, FIG. 4 is a front view and side view of a hinge for use with a shower chair, according to one embodiment of the invention. FIG. 4 shows hinge 204 including post 420, pin 422, socket 423, stopper 426, shaft 428, and flange 421 (e.g., such as a top portion of socket 423, joining socket 423 to shaft 428) in front view 400 and side view 410. Shaft 428 may be part of, or attached to back portion 240. Thus, FIG. 4 shows that seat portion 201 and shaft 428 are not restricted from moving along arc R1, however, shaft 428 is restricted or prohibited from moving along arc R3 by stopper 426 engagement of flange 421. Since shaft 428 may be part of or attached to back portion 240 it follows that in accordance with an embodiment described by FIG. 4, back portion 240 and seat portion 201 may move along arc R1 as shown in FIGS. 2–4, but that back portion 240 may be restricted or prohibited from moving along arc R3 as shown in FIGS. 2 and 4.

Note that in some embodiments the height, thickness, flexibility and/or material of post 420, stopper 426, flange 421, and/or socket 423 may be selected to allow back portion 240 to have limited movement along arc R3, such as in an amount of between 5 degrees and 45 degrees below vertical when a person sitting on seat 11 pushes or leans against back portion 240. Moreover, it is contemplated that the location of pin 422, and/or the shape of post 420, stopper 426, flange 421, and/or socket 423 may be selected to provide various vertical dispositions of back portion 240 with respect to bottom portion 201 (e.g., such as a vertical disposition other than the right angle back portion 240 forms with respect to bottom portion 201 shown in FIG. 2), and/or to allow back portion 240 to be adjusted along a limited range of arc R3 (e.g., such as described above). Specifically, different locations or more than one location for pin 422 may be selected in post 420 and/or socket 423 (e.g., such as by adding a second hole through socket 423 farther back towards stopper 426 in direction D1 than the one already shown in side view 410 of FIG. 4); and/or different gaps along the back of flange 421 may be selected (e.g., such as by selecting a gap extending further back in distances along direction D1 towards stopper 426 than the one already shown in side view 410 of FIG. 4). Conversely, it is also considered that shaft 428 may include a post like structure for engaging a socket type structure attached to bottom portion 201. Thus, these converse structures may function similarly to those described above for FIG. 4.

Figure 5:
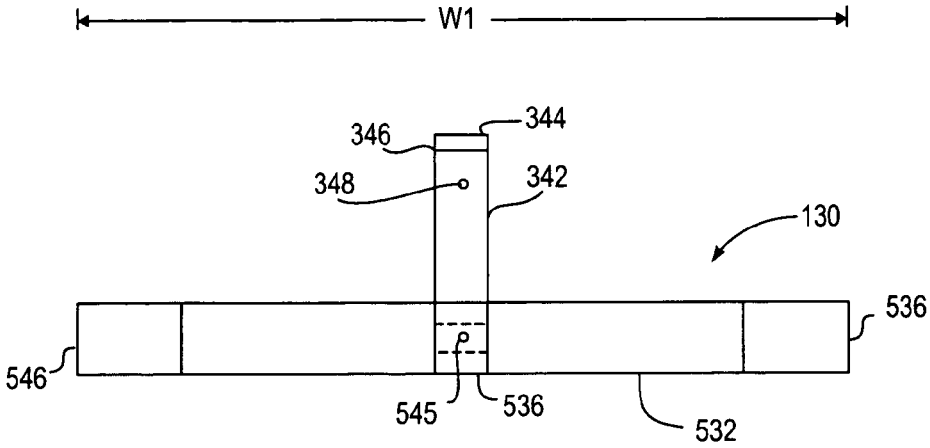
FIG. 5 is a front view of a back portion of a frame, according to one embodiment of the invention.

FIG. 5 is a front view of a back portion of a frame, according to one embodiment of the invention. FIG. 5 shows second end 130 having hook member 344 hingedly attached by hinge 346 to member 342 having attachment 348 attached to member 342. Member 342 is attached to second end member 130 by band 536 and/or attachment 545. For example, band 536 may be a band, sleeve, a screw clamp, a pressure clamp, a screw sleeve, or clamp of material formed or folded around the structure of second end member 130 and attachment 545 may be an attachment similar to that described with respect to attachment 348. Thus, member 342 may be attached to or include band 536 which is attached to second end member 130 at a position along width W1 of second end member 130.

Moreover, according to embodiments, although the position of member 342 and hook member 344 are shown at the center of width W1, member 342, hook member 344, and the associated structures may be placed at various other positions along with W1 as desired. Furthermore, according to embodiments, width W1 of second end member 130 and of first end member 150 may be adjustable to a length appropriate to insure that first and second longitudinal members 110 and 120 which are attached to first and second end members 130 and 150, as shown in FIG. 1, are disposed on upper surface 192 of a bath enclosure. For instance, FIG. 5 shows attachment 536 and 546 for attaching second end member 130 to first and second longitudinal members 110 and 120. Thus, width W1 determines the distance between outer edges of attachment 536 and 546, which determines the distance between outer edges of first and second longitudinal members 110 and 120 which determines a distance between outer edges of wheels 131/132 and wheels 133/134.

For example, first and second end members 150 and 130 may have telescoping portions to provide lateral adjustment of frame 12 to have width W1 in the range of between 24 inches and 34 inches in length. Furthermore, according to embodiments, first and second end members 150 and 130 may include a turn buckle, multiple bands, (e.g., such as band 536), or various other appropriate systems for providing a lateral adjustment, such as to adjust width W. For example, a turn buckle such as turn buckle 152 may be used along the lateral portion of first and second end members 150 and 130 to adjust W1 of first and second end members 150 and 130.

Figure 6:
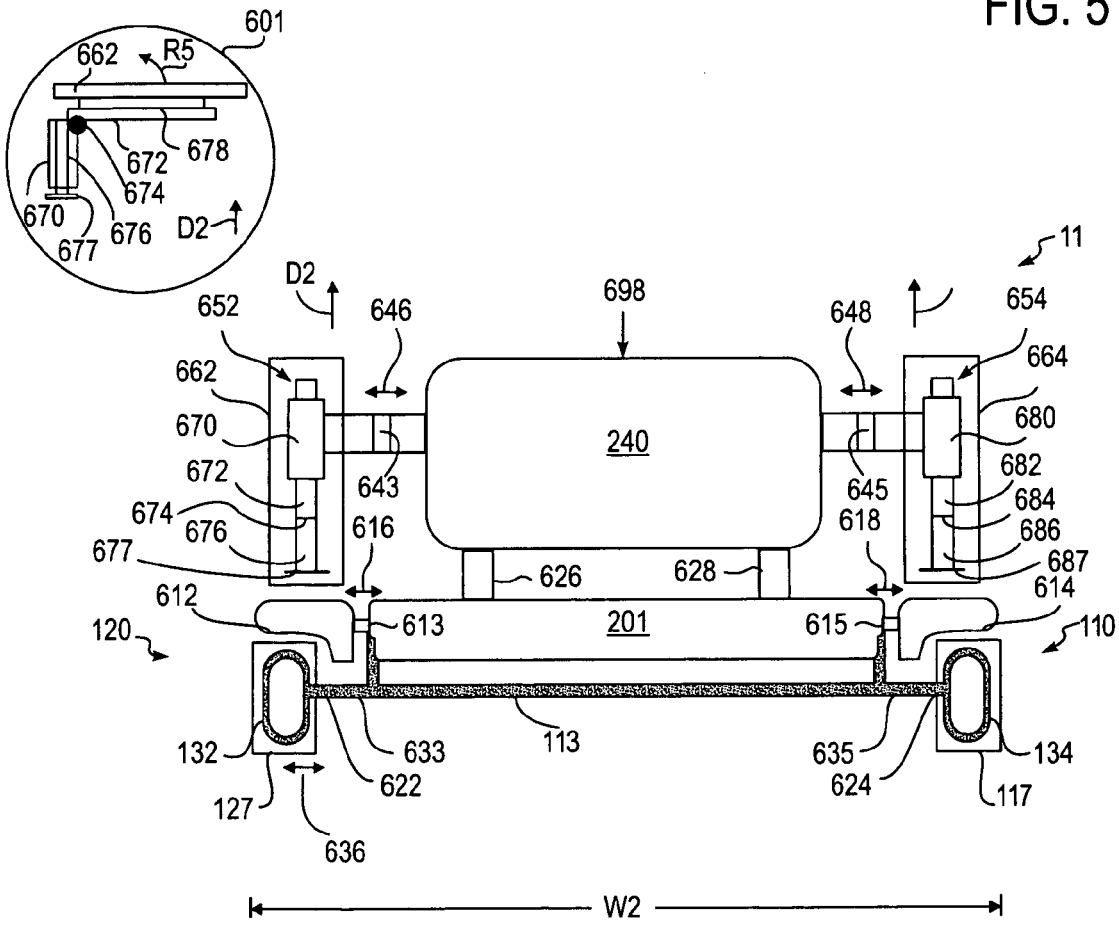
FIG. 6 is a front plan view of a shower chair, in accordance with one embodiment of the invention.

Correspondingly, the width between wheels 131/132 and wheels 133/134 may be adjustable to insure that the wheels fit onto and roll on wheel tracks 117 and 127 appropriately. For example, FIG. 6 is a front plan view of a shower chair, in accordance with one embodiment of the invention. FIG. 6 shows wheel 132 (e.g. end wheel 131) and wheel 134 (e.g. end wheel 133) having width W2, such as a proper width to fit wheels 132 and 131 into a passage of second longitudinal member 120, and to fit wheels 133 and 134 into a passage of first longitudinal member 110 as shown in FIG. 6. It is contemplated that carriage 113 may have lateral adjustment 635, such as telescoping axles between wheels 131/132 and 133/134, for adjusting width W2 to cause the wheels to align properly with first and second wheel track 117 and 127. Specifically, FIG. 6 shows carriage 113 including axle 633 disposed through first bearing 622 (e.g., such as a bearing of plastic washers, or a bearing or bushing as described herein) of wheel 132 and disposed through second bearing 624 (e.g., such as a bearing as described with respect to bearing 622) of wheel 134. As shown, axle 633 includes lateral adjustment 635 which allows width W2 to be adjusted in directions 636, such as to insure that the wheels fit properly on first and second wheel tracks 117 and 127 and/or within first and second longitudinal members 110 and 120 as described herein.

Correspondingly, seat 11 may include horizontal surfaces, similar to horizontal surface 284 and armrest similar to armrest 260 that are attached to lateral adjustments similar to lateral adjustment 635 and/or the lateral adjustment for second end member 130 as described herein, to adjust a width between the horizontal surface and armrest on one side of the chair and the horizontal surface and armrest on the other side of the chair. For example, FIG. 6 shows first horizontal surface 612 attached to lateral adjustment 613 for adjusting and second horizontal surface 614 attached to lateral adjustment 615, such that width W2 between first horizontal surface 612 and second horizontal surface 614 may be adjusted along directions 616 and 618. Similarly, first armrest 662 is attached to lateral adjustment 643 and second armrest 664 is attached to lateral adjustment 645, such that width W2 between first armrest 662 and second armrest 664 may be adjusted along directions 646 and 648.

According to embodiments, lateral adjustments 616, 618, 643, and 645 may be adjustments similar to lateral adjustment 635 and/or adjustment described for adjusting width W1 of second end member 130. Note that although FIGS. 1 and 6 show seat 11 centered (e.g., see FIG. 6 showing seat 11 including seat portion 201 and back portion 240 at centered position 698), seat 11 may be off center (e.g., such as by being laterally offset along width W1 to one side or the other of centered position 698).

FIG. 6 also shows first shaft 626 and second shaft 628 for attaching back portion 240 to seat portion 201. It is contemplated that first and second shafts 626 and 628 may be shafts similar to shaft 428 and thus may attach back portion 240 to seat portion 201 via hinges similar to hinge 204 as described herein. It is also contemplated that seat 11 may include a seat belt, such as a belt with a buckle structure attached to back portion 240, or attached between shaft 626 and shaft 628.

In addition, first and second armrests 662 and 664 may be attached to lateral adjustments 646 and 648 by first and second stow 652 and 654 respectively. As shown in FIG. 6, stow 652 has first sleeve 670, first shaft 672 disposed through first sleeve 670 and attached to first armrest 662, and first hinge 674 hingedly attaching first tail 676 to the bottom of first shaft 672. First stow 652 is shown attached to first sleeve 670. Thus, when first armrest 662 is moved upwards in direction D2, first shaft 672 may be slid up through first sleeve 670 until only first tail 676 is left disposed within first sleeve 670. In this position, first armrest 662 and first shaft 672 may be rotated at first hinge 674 with respect to first tail 676 so that first armrest 662 is swung down into a horizontal position and disposed parallel to seat portion 201. First armrest 662 may be retained in a position parallel to seat portion 201 by first tail 676 being retained within first sleeve 670 and first hinge 674 having characteristics to retain first shaft 672 in a horizontal position, such as an orientation parallel to seat portion 201. Thus, first armrest 662 may be folded down into the horizontal position shown in cross sectional side view 601 of FIG. 6. Note that cross sectional side view 601 also shows fin 678 attaching first shaft 672 to first armrest 662. Although FIG. 6 shows fin 678 as a single fin, it is contemplated that more than one fin may be used to attach first armrest 662 to first shaft 672 (e.g., such as the fin that would remain at each end of armrest 662 if a center portion of fin 678 did not exist).

It can be appreciated that armrest 662 can be returned from the horizontal position of view 601 to the vertical position shown at seat 11 of FIG. 6, by rotating first armrest 662 in the direction shown by arc R5 of view 601 until first shaft 672 is oriented vertically so that first shaft 672 may slide in a direction opposite direction D2, and down through first sleeve 670. Thus, first shaft 672 may be slid down through first sleeve 670 in a direction opposite direction D2 until first armrest 662 is stowed in the vertical position shown at seat 11 of FIG. 6. It is contemplated that a cross section of first sleeve 670, first shaft 672, and/or first tail 676 (e.g., such as a cross section from a perspective taken by looking in direction D2) may provide a circular, square, or other appropriate geographic profile shape for functioning as described above. In addition, first stow 652 may include first flange 677 to restrict movement of first tail 676 with respect to first sleeve 670, such that first tail 676 cannot move farther in direction D2 when first flange 677 is pressed against the bottom of first sleeve 670.

FIG. 6 also shows second stow 654 having second sleeve 680, second shaft 682, second hinge 684, and second tail 686, which may attach and function similarly to the corresponding features of first stow 652, as described above. Furthermore, according to embodiments, first and second armrest 662 and 664 may include support members similar to support member 280 as described with respect to armrest 260 in FIG. 2. More particularly, a support member for first armrest 662 may engage first horizontal surface 612, and a support member for second armrest 664 may engage second horizontal surface 614 to reduce tipping of seat 11 as described with respect to FIG. 2.

Thus, first and second stow 652 and 654 as described above, may be a stow similar to stow 262, and/or may be a stow to allow first and second armrest 662 and 664 to be folded, disposed vertically, or otherwise positioned so that they (e.g., such as by being vertically oriented as shown in FIG. 6) do not interfere with moving seat portion 201 along arc R1 into stowed position 300 or extend along arc R1 beyond chassis 113 when seat portion 201 is in stowed position 300, as shown in FIG. 3. For example, first and second stow 652 and 654 may include a hinge, a pin, a rotator, a sleeve and shaft, or any of various other appropriate stow devices.

Figure 7:
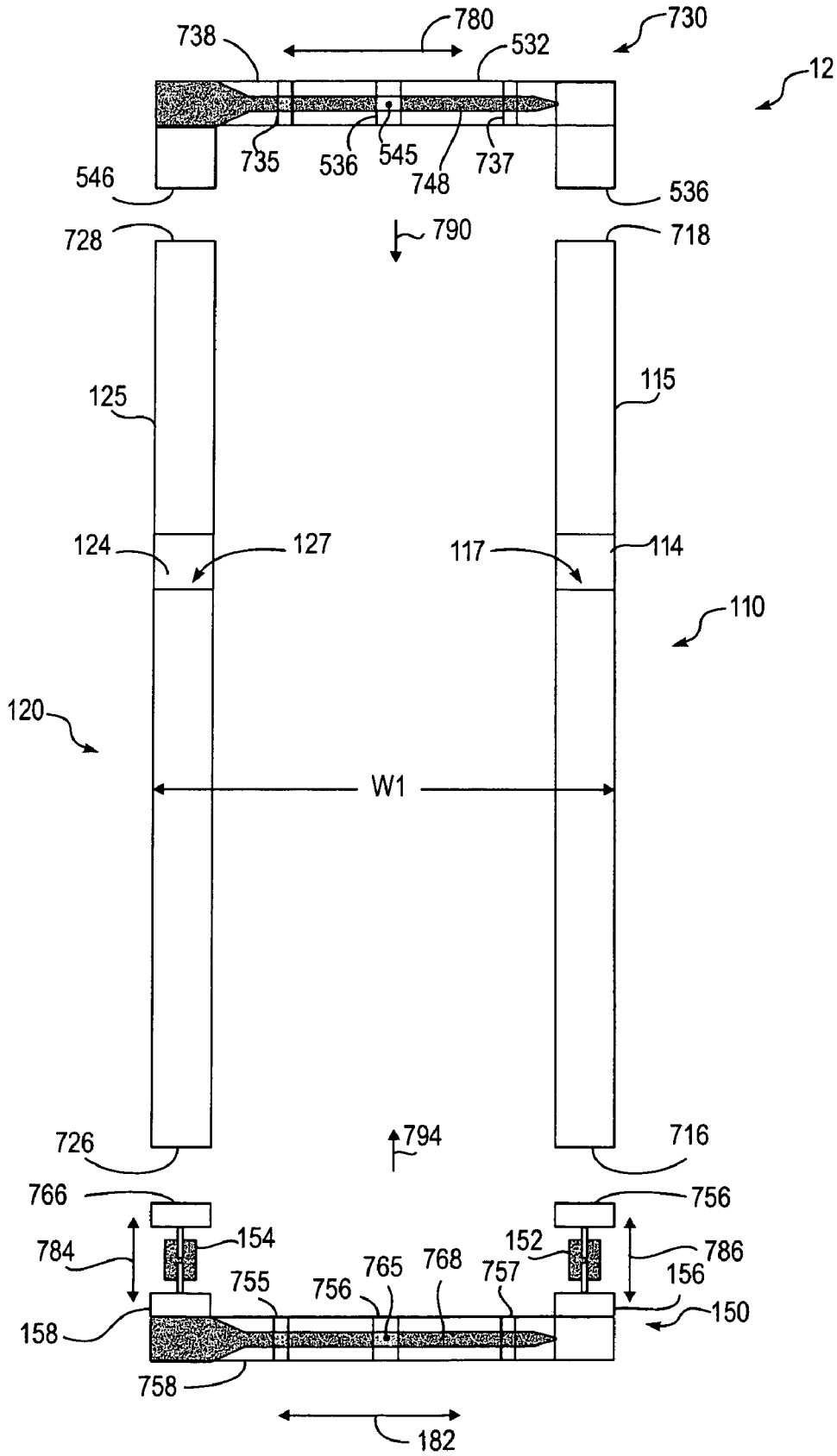
FIG. 7 is a top plan view of a frame, in accordance with one embodiment of the invention.

According to embodiments, seat 11 and/or frame 12 may be configured for easy assembly and disassembly, such as to be portable devices. For instance, as shown in FIG. 6, seat 11 may include various lateral adjustments, armrest stows, and hinges, such as hinge 204 to allow seat 11 to fold into a compact configuration. Similarly, frame 12 may include attachments for removably attaching first and second longitudinal members 110 and 120 from first and second end members 150 and 130. For example, FIG. 7 is a top plan view of a frame, in accordance with one embodiment of the invention. FIG. 7 shows first back length 115 having attachment 718 for attaching to attachment 536 of second end member 130. Attachments 718 and 536 may include structure for attaching such as by telescoping when attachment 536 slides into a sleeve or passage at attachment 718, or by other appropriate attachment means, including screws, nuts, bolts, adhesive, tape, and/or bands as described herein. FIG. 7 also shows attachments 728 and 546, 726 and 766, and 716 and 756 which may be attachments similar to those described above for attachments 718 and 536. Thus, it is possible to move first end member 150 in direction 794 to attach it to first and second longitudinal members 110 and 120. Similarly it is possible to move second end member 130 in direction 790 to attach it to first and second longitudinal members 110 and 120.

FIG. 7 also shows second end member 130 including shaft 748 for fitting within sleeve 532 so that shaft 748 may be moveable to provide lateral adjustment of width W1 of second end member 130. Thus width W1 may be adjusted by moving shaft 748 in direction 780 until a desirable width is obtained. FIG. 7 also shows bands 735, 536, and 737 disposed around or in circling sleeve 532 and shaft 748, such as to hold sleeve 532 and shaft 748 super adjacent to each other allowing frame 12 to function as described herein. Moreover, band 735, 536, and/or 737 may include a tightening mechanism, such as an attachment described with respect to attachment 545, or a screw-clamp mechanism such as used on a automobile radiator hose, or bolt device such as used on a metal bed frame to secure shaft 748 to sleeve 532 so that frame 12 may operate as described herein. Moreover, band 536 may include attachment 545 to attach band 536 to member 342 as described herein.

Similarly, FIG. 7 shows first end member 150 having shaft 768 and sleeve 758 which may be similar to shaft 748 and sleeve 532 as described above. Likewise, bands 755, 756, and 757, and attachment 765 may be similar to bands 735, 536, and 737 and attachment 545 as described above. Thus, first end member 150 may be adjusted laterally to width W1 along direction 182 as described above.

Also, FIG. 7 shows first and second turnbuckles 152 and 154 attached to first and second front ends 156 and 158 and attached to attachments 756 and 766, such as by a weld, a nut, a bolt, a screw, or an adhesive attachment. Thus, first and second turnbuckles 152 and 154 may be rotated to expand or contract the turnbuckles in directions 786 and 784 respectively. Specifically, for example, first and second turnbuckles 152 and 154 may be seven inch long metal turnbuckles having a five inch adjustment range in directions 786 and 784. It is to be appreciated that expansion or compression of the turnbuckles in direction 786 and 784 will provide first and second pressures PR1 and PR2, as shown in FIG. 1, respectively.

It is contemplated that first end 150 may be attached to first and second longitudinal members 110 and 120; second end 130 may be attached to first and second longitudinal members 110 and 120; length L1 of frame 12 may be adjusted; width W1 of first end member 150 may be adjusted; width W1 of second end member 130 may be adjusted; width W1 of wheels 131/132 and 133/134 may be adjusted; and/or wheels 131 through 134 may be introduced to first and second wheel tracks 114 and 124 in various sequences or order prior to or after setting frame 12 or parts of frame 12 onto upper surface 192. After setting or disposing frame 12 on upper surface 192, further adjustment of first turnbuckle 152 and/or second turnbuckle 154 may be performed to provide adequate first and second pressures PR1 and PR2 for appropriate pressure fitting of frame 12 to end surfaces of bath enclosure 190 as described herein.

According to embodiments, first and second longitudinal members 110 and 120 may include a joint or removable attachment for removably connecting a front portion of each member to a back portion of each member. For example, FIG. 8 is a top plan view of a pair of longitudinal members having a male/female joint to separate the longitudinal members into two portions of length, in accordance with one embodiment of the invention. FIG. 8 shows first longitudinal member 110 having male/female joint 864 for attaching first back length 115 to first front length 812 at position 866, such that first back length 115 may be moved in direction D3 and separated from first front length 812. Similarly, second longitudinal member 120 includes male/female joint 860 for attaching second back length to second front length 822 at position 862, such that second back length 125 may be moved in direction D3 and be separated from second front length 822.

Specifically, as shown in FIG. 8, first and second front lengths 812 and 822 may include a male portion extending between 1 inch and 3 inches in length along direction D3 (e.g., such as a male portion extending 2 inches in direction D3) for engaging or sliding within a female portion of first and second back lengths 115 and 122, extending to a corresponding length as described above for the male portion. Thus, for example, first and second longitudinal members 110 and 120 may be made of a plastic having ¼ inch thickness where a 2 inch long male portion having ⅛ inch thickness extend from first and second front lengths 812 and 822 into a female portion of first and second back lengths 115 and 125 having a 2 inch length and a ⅛ inch thickness for surrounding and engaging the male portion. It can be appreciated that the male/female joints are capable of withstanding pressures PR1 and PR2, and that the male and female parts of the male/female joints may be switched with respect to whether they exist on the back or front lengths of first and second longitudinal members 110 and 120.

FIG. 9 is a top plan view of a longitudinal member separated into two portions of length at a male/female joint, in accordance with one embodiment of the invention. FIG. 9 shows first longitudinal member 110 separated into two portions of length where first back length 115 includes female portion 915 of male/female joint 864, having length FL and thickness FT. First front length 812 includes male portion 912 of male/female joint 864, having length ML and thickness MT.

Although FIGS. 8 and 9 show the longitudinal portions with one male/female joint disposed at the midpoint of the longitudinal member's length, it is considered that first and second longitudinal members 110 and 120 may each include more than one male/female joint and/or may include one or more male/female joints at positions along the length of the longitudinal members other than at the midpoint of length (e.g., such as by having a male/female joint at ¼, ⅓, ⅔, and/or ¾ of length L2 as shown in FIG. 1).

Moreover, it can be appreciated that first and second longitudinal members 110 and 120 may have various other appropriate joints or structures to separate or fold the members into portions of length. For instance, male/female joints 864 and 860, and positions 866 and 862 may include various structures such as engaging slots, pull apart joints, pull apart hinges, stretch hinges, and/or other components to move first and second back length 115 and 125 away from first and second front lengths 812 and 822 prior to or during separation of first and second longitudinal members 110 and 120 into two or more portions of length of the longitudinal members. Specifically, instead of a male/female joint, a hinge may hingedly attach the back lengths to the front lengths of first and second longitudinal members 110 and 120 at positions described above so that the members can be folded into portions of length. Hence, seat 11 and frame 120 may include structures described herein so that seat 11 and frame 120 may be separated and/or folded into a compact portable form, such as to be placed in a box for carrying.

Also, according to embodiments, first and second longitudinal members 110 and 120 may include one or more extender locations to add extenders to extend longitudinal members 110 and 120 and/or to removably attach one or more portions of longitudinal members 110 and 120 without extenders. Moreover, first and second longitudinal members 110 and 120 and the extenders may include one or more rod and rod hole locations to insert rods into longitudinal members 110 and 120 (e.g., such as with or without the extenders) to give frame 12 sufficient structural stability to support a 100 to 400 pound load in seat 11 (e.g., such as a 200 pound load or person in seat 11).

Figure 10:
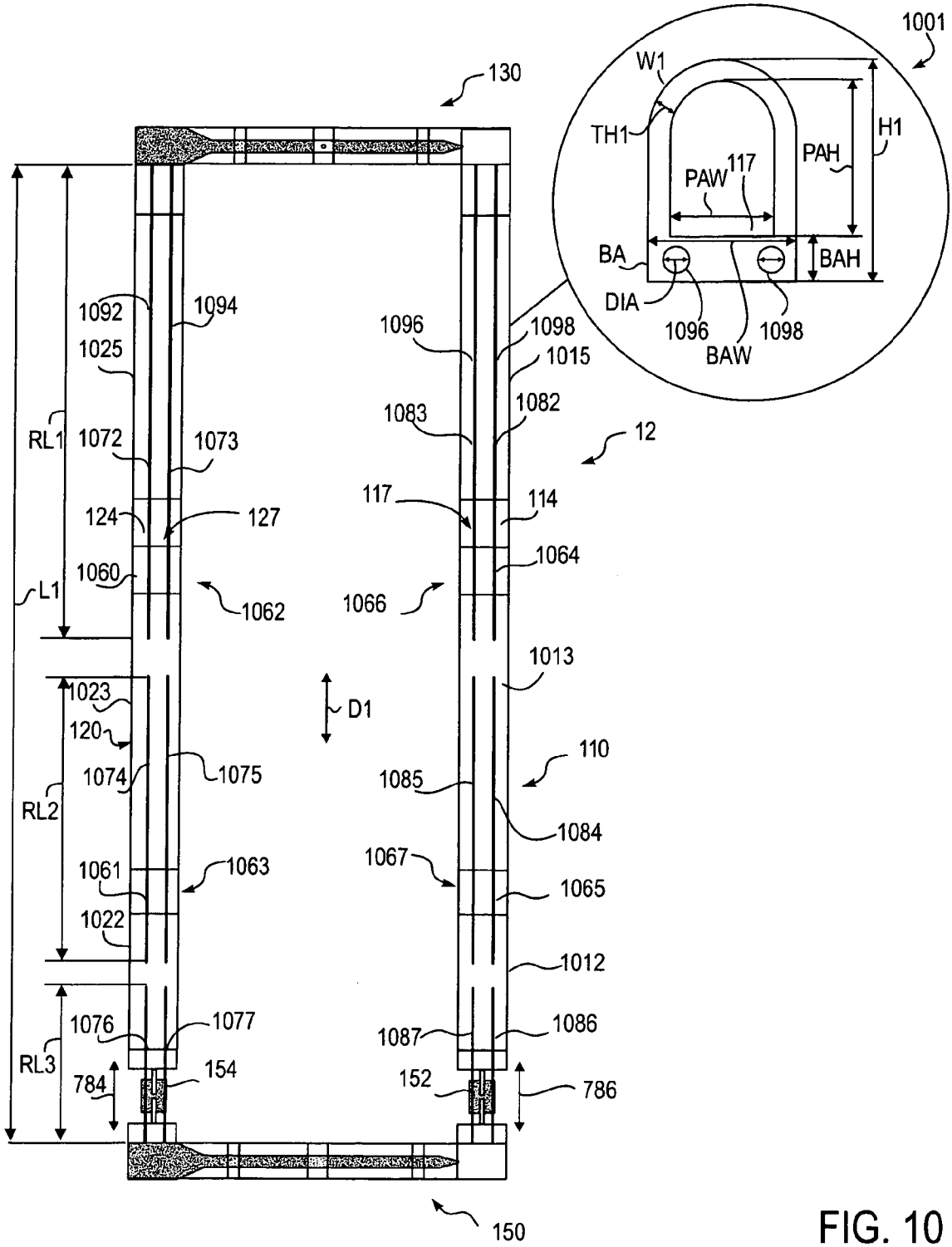
FIG. 10 is a top plan view of a frame, in accordance with one embodiment of the invention.

For example, FIG. 10 is a top plan view of a frame having two extender locations, in accordance with one embodiment of the invention. FIG. 10 shows longitudinal members 110 and 120 having extender locations 1062, 1063, 1066, and 1067 and extenders 1060, 1061, 1064, and 1065 therein respectively to extend longitudinal members 110 and 120 in direction D1 and/or removably attach portions 1025, 1023, 1022 and 1015, 1013, 1012 respectively of longitudinal members 110 and 120. For example, each of extenders 1060, 1061, 1064, and 1065 may be one or more similarly or differently spaced extenders, such as one or more of a 2.5 inch, 5 inch, and/or 7.5 inch extender. More particularly, availability of a 2.5 inch extender piece and a 5 inch extender piece for each of extenders 1060, 1061, 1064, and 1065 may provide for extenders of 2.5 inches, 5 inches, and 7.5 inches for each of extenders 1060, 1061, 1064, and 1065.

Moreover, FIG. 10 shows longitudinal members 110 and 120, and extenders having rods 1072, 1073, 1074, 1075, 1076, 1077 inserted into or disposed in rod hole locations 1092 and 1094 of longitudinal member 120; and rods 1082, 1083, 1084, 1085, 1086, 1087 inserted into or disposed in rod hole locations 1096 and 1098 of longitudinal member 110. Note that rods 1072–1087 may also be inserted in to corresponding hole locations of extenders 1060, 1061, 1064, and 1065. Thus, rods 1072–1087 may removably attach portions 1025, 1023, 1022 and 1015, 1013, 1012, and extenders 1060, 1061, 1064, and 1065 of longitudinal members 110 and 120.

According to embodiments rods 1072–1087 may be rods or inserts of a sufficiently supportive material, rod length, rod thickness or size, and rod shape so that when the rods are inserted into a portion of the longitudinal members 110 and 120 (e.g., such as inserted into or disposed in rod holes below wheel tracks 117 and 127) that frame 12 has sufficient structural stability to support a 100 to 400 pound load in seat 11 (e.g., such as a 200 pound person using seat 11, as described above) in a bathing enclosure 190. For instance, rods 1072–1087 may be ¼ inch diameter rods or inserts of metal material and may have lengths as described below.

Furthermore, according to embodiments rod hole locations 1092 and 1094 may extend completely through longitudinal member 120 or from one end of longitudinal member 120 to the other end of that member without exiting longitudinal member 120. Correspondingly, rod hole locations 1096 and 1098 may extend completely through longitudinal member 110 or from one end of longitudinal member 110 to the other end of that member without exiting longitudinal member 110.

For instance, exploded view 1001 of FIG. 10 shows a cross section of first and/or second longitudinal members 110 and 120. As shown in exploded view 1001, first and second longitudinal members 110 and 120 may having height H1 between 2 inches and 4 inch in height (such as a height of 3 inches), walls W1 with thickness TH1 between ⅛ inch and ½ inch thick (such as a thickness of ¼ inch), base BA with width BAW between 1 inch and 2 inches width (such as a width of 1.5 inches). Also, FIG. 10 shows base BA that may have height BAH between ½ inch and 1 inch thick (such as a height of ¾ inch) and rod hole locations 1096 and 1098 having a diameter DIA between ⅛ inch and ½ inch diameter (such as a diameter of ¼ inch). For example, FIG. 10 shows first and second longitudinal members 110 and 120 having walls W1 and base BA defining passage PA, which may function similar to passage B as described above, where passage PA has height PAH between 1.5 inches and 2.5 inches in height (such as a height of 2 inches) and width PAW between 0.5 inch and 1.5 inches width (such as a width of 1 inch). Note that extenders 1060, 1061, 1064, and 1065 may have a cross section profile similar to that described above for first and second longitudinal members 110 and 120.

Additionally, as shown in FIG. 10 rods 1072, 1073, 1082, and 1083 may have length RL1 between 25 inches and 40 inches in length (such as a length of 32 inches); rods 1074, 1075, 1084, and 1085 may have length RL2 between 5 inches and 30 inches in length (such as a length of 10 or 20 inches); and rods 1076, 1077, 1086, and 1087 may have length RL3 between 7 inches and 20 inches in length (such as a length of 10.5 inches). Thus, it can be appreciated that rods 1072–1087 may removably attach portions 1025, 1023, 1022 and 1015, 1013, 1012, with or without extenders 1060, 1061, 1064, and 1065 of various lengths to form first and second longitudinal members 110 and 120 having length L1 of between 53 inches and 73 inches in length.

Moreover, it is contemplated that rods 1072, 1073, 1076, 1077 may be fixed or attached after insertion at rod hole locations 1092 and 1094 of longitudinal member 120; and rods 1082, 1083, 1086, 1087 may be fixed or attached after insertion at rod hole locations 1096 and 1098 of longitudinal member 110, as shown in FIG. 10. Specifically, rods 1072 and 1073 may be fixed at rod hole locations 1092 and 1094 of longitudinal member 120, as shown in FIG. 10, by friction, heat bonding, adhesive, threads, attachment to second end member 130, or other suitable means. Also, rods 1082 and 1083 may be fixed at rod hole locations 1096 and 1098, as shown in FIG. 10, similarly to the fixation described above for rods 1072 and 1073. Likewise, rods 1076 and 1077 may be fixed at rod hole locations 1092 and 1094 of longitudinal member 120, as shown in FIG. 10, by friction, heat bonding, adhesive, threads, attachment to first end member 150, or other suitable means. Also, rods 1086 and 1087 may be fixed at rod hole locations 1096 and 1098, as shown in FIG. 10, similarly to the fixation described above for rods 1076 and 1077. Finally, rods 1074 and 1075 may be removably inserted or disposed at rod hole locations 1092 and 1094 of longitudinal member 120, as shown in FIG. 10, by friction or other suitable means. Also, rods 1084 and 1085 may be removably inserted or disposed at rod hole locations 1096 and 1098, as shown in FIG. 10, similarly to that described above for rods 1074 and 1075.

Therefore, it is possible for rods 1072, 1073, 1082 and 1083 to be 32 inch rods fixed in locations; for rods 1076, 1077, 1086 and 1087 to be 10.5 inch rods fixed in locations; and for rods 1074, 1075, 1084 and 1085 to be either 10 inch rods or 20 inch removable rods in locations, as shown in FIG. 10, so that longitudinal member 110; and 120 may be assembled with or without extenders 1060, 1061, 1064, and 1065 to form longitudinal members having a length of 53, 60, 66, 72, or 73 inches (e.g., depending on how many and what length extenders, as described above, are used).

Thus, FIG. 10 shows first and second longitudinal members 110 and 120 two extender locations for up to 3 extenders each and two rod hole locations for two rods in each longitudinal member such that frame 12 has sufficient structural stability to support a 100 to 400 pound load in seat 11 (with or without the extenders) even when only the ends of longitudinal members 110 and 120 adjacent to end surfaces 198, or a portion of longitudinal members 110 and 120 adjacent to those ends, are disposed on upper surface 192 of a bath enclosure 190. For instance, in embodiments, less than 25, 20, 15, 10, or 5 percent of the longitudinal members may be disposed on upper surface 192 of a bath enclosure.

Note that in addition to the configurations shown in FIG. 10 and discussed above, various other configurations of extender locations, extender lengths, rod hole locations, and rods for the longitudinal members are contemplated. Specifically, it is contemplated that longitudinal members 110 and 120 may include any appropriate combination of one or more extender locations, extenders, rods, and/or rod hole locations to extend and support longitudinal members 110 and 120 such that frame 12 has sufficient structural stability to support a 100 to 400 pound load in seat 11 (with or without the extenders) even when only the ends of longitudinal members 110 and 120 adjacent to end surfaces 198, or a portion of longitudinal members 110 and 120 adjacent to those ends, are disposed on upper surface 192 of a bath enclosure 190.

Also, embodiments corresponding to FIG. 10 and the description above related thereto may be stowable as described above with respect to FIGS. 8 and 9. Thus, portions 1025, 1023, 1022, 1015, 1013, and 1012 (and optionally extenders 1060, 1061, 1064, and 1065) of longitudinal members 110 and 120, and rods 172–187 may be moved in direction D1 to detach portions 1025, 1023, 1022, 1015, 1013, and 1012 (and optionally extenders 1060, 1061, 1064, and 1065) from each other so that those components may be separated and/or folded into a compact portable form, such as to be placed in a box for carrying.

In the foregoing specification, specific embodiments are described. However, various modifications and changes may be made thereto without departing from the broader spirit and scope of embodiments as set forth in the claims. The specification and drawings are, accordingly, to be regarded in an illustrative rather than a restrictive sense.

What is claimed is:

1. An apparatus comprising:

a seat mounted on a plurality of wheels;

a frame having a pair of longitudinal members each defining a wheel track, the longitudinal members retained in substantially parallel relation by a first and second end members, the frame to be disposed on an upper surface of a bath enclosure; and a pair of turnbuckles to couple the longitudinal members to the first end member to provide longitudinal adjustment of the frame.

2. The apparatus of claim 1 wherein the longitudinal adjustment permits the frame to form a friction fit with a bath enclosure having a length in the range of 53 inches and 73 inches in length.

3. An apparatus comprising:

a seat mounted on a plurality of wheels;

a frame having a pair of longitudinal members each defining a wheel track, the longitudinal members retained in substantially parallel relation by a first and second end members coupled between the pair of longitudinal members, the longitudinal members having ends to be disposed on an upper surface of a bath enclosure, such that the longitudinal members follow a long dimension of the bath enclosure and having sufficient structural stability to support a 200 pound load in the seat;

wherein each longitudinal member includes a first member detachably coupled to a second member by a first pair of rods extending longitudinally through the first and second members, and the second member detachably coupled to a third member by a first pair of rods extending longitudinally through the first and second members, to allow the first and third members to be separated from the second member such that when detached, the first member, second member, and the third member each have a length less than a half length of the longitudinal member.

4. The apparatus of claim 3 wherein less than 15 percent of the longitudinal members are to be disposed on the upper surface of a bath enclosure.

5. The apparatus of claim 3 wherein each longitudinal member includes a first extender detachably coupled between the first and the second member, and a second extender the detachably coupled between the second and the third member.

6. An apparatus comprising:

a seat mounted on a plurality of wheels and having a pair of stowable arm rests, a back portion, and a seat portion hingedly coupled to the back portion and moveable between a use position and a stowed position, wherein the arm rests include an arm platform coupled proximate to the back portion; and a support member hingedly coupled to the arm platform distal to the back portion to engage a horizontal surface to reduce tipping when pressure is applied to the arm platform; and a frame having a pair of longitudinal members each defining a wheel track in which a subset of the wheels resides during use, the longitudinal members retained in substantially parallel relation by a first and second end members, the frame to be disposed on an upper surface of a bath enclosure.

7. An apparatus comprising:

a seat mounted on a plurality of wheels;

a frame having a pair of longitudinal members each defining a wheel track in which a subset of the wheels resides during use, the longitudinal members retained in substantially parallel relation by a first and second end members, the frame to be disposed on an upper surface of a bath enclosure, wherein the seat comprises:

a back portion;

a seat portion hingedly coupled to the back portion and moveable between a use position and a stowed position; and a hook member extending from the second end member to engage the seat when in the showed position.

8. The apparatus of claim 7, wherein the plurality of wheels comprises a front pair of wheels and a rear pair of wheels and wherein the longitudinal members define a slot in an upper wall the slot overlying the front pair of wheels when the seat is at an extreme of its range of motion along the wheel tracks.

9. The apparatus of claim 7 wherein the seat comprises;

a pair of stowable arm rests.

10. The apparatus of claim 7 further comprising:

a braking mechanism to restrict motion of the seat along the wheel tracks.

11. An apparatus comprising:

a seat mounted on a plurality of wheels;

a pair of longitudinal members each defining a wheel track, a first and second end member coupled between respective ends of the pair of longitudinal members, the end members to be pressure fit to vertical surfaces of a bath enclosure.

12. The apparatus of claim 11 wherein each longitudinal member includes a first member detachably coupled to a second member to allow the first member to be separated from the second member such that when detached, the first member and the second member each have a length less than a length of the longitudinal member.

13. The apparatus of claim 11 wherein the first and second end members telescope to provide lateral adjustment of the frame.

14. The apparatus of claim 11 wherein the longitudinal members are to be retained in substantially parallel relation by the first and second end member.

15. The apparatus of claim 14 wherein the first and second end members telescope to provide lateral adjustment of the frame to have a length in a range of 24 inches and 34 inches in length.

* * * * *

UNITED STATES PATENT AND TRADEMARK OFFICE

CERTIFICATE OF CORRECTION

PATENT NO. : 7,155,757 B1
APPLICATION NO. : 10/773999
DATED : January 2, 2007
INVENTOR(S) : Zamora, Jr.

It is certified that error appears in the above-identified patent and that said Letters Patent is hereby corrected as shown below:

Column 16: In Claim #7, Line #15, please delete "showed" and insert -- stowed --.

Signed and Sealed this

Fourteenth Day of August, 2007

JON W. DUDAS
*Director of the United States Patent and Trademark Office*